US006026612A

United States Patent [19]

Strassel et al.

[11] Patent Number: 6,026,612

[45] Date of Patent: Feb. 22, 2000

[54] ROLLING DEVICE HAVING A PLURALITY OF RECESSES FOR ADJUSTING A LEVEL OF A SLIDING LEAF

[75] Inventors: Richard Strassel, Berthelming; Gérard Prevot, Willerwald, both of France

[73] Assignee: Ferco International Ferrures et Serrures de Bâtiment Société Anonyme,, Sarrebourg, France

[21] Appl. No.: 08/977,008

[22] Filed: Nov. 24, 1997

[30] Foreign Application Priority Data

Dec. 3, 1996 [FR] France ..... 96 14990

[51] Int. Cl.[7] ..... E05D 13/00; A47H 15/00

[52] U.S. Cl. ..... 49/425; 49/409; 49/410; 16/91; 16/105; 16/100

[58] Field of Search ..... 49/425, 409, 410, 49/427; 16/91, 105, 100

[56] References Cited

U.S. PATENT DOCUMENTS

| | | | |
|---|---|---|---|
| 3,176,757 | 4/1965 | Lomaz | 160/209 |
| 3,208,109 | 9/1965 | Buck | 49/425 |
| 3,996,643 | 12/1976 | Steigerwald | 16/99 |
| 4,633,615 | 1/1987 | Moose | 49/425 |
| 4,899,493 | 2/1990 | Baumgarten | 49/425 |
| 5,018,306 | 5/1991 | Prevot | 49/425 |
| 5,404,675 | 4/1995 | Schmidhauser | 49/409 |
| 5,791,089 | 8/1998 | Prevot et al. | 49/425 |

FOREIGN PATENT DOCUMENTS

| | | | |
|---|---|---|---|
| 2136938 | 7/1971 | Germany | 49/425 |

*Primary Examiner*—Daniel P. Stodola
*Assistant Examiner*—Gregory J. Strimbu
*Attorney, Agent, or Firm*—Harrison & Egbert

[57] ABSTRACT

An apparatus having a sliding leaf, a slide member, at least two rail wheels mounted on respective spindles, a mounting mechanism affixed to the slide member and extending in a direction perpendicular to a plane of the sliding leaf, and fixing lugs affixed to and extending outwardly from a lower edge of the slide member at respective ends of the slide member. The slide member is a casing having two sets of recesses. The recesses in each set of recesses increase in height from a center of the casing to a respective end of the casing. The recesses in each set extend from the lower edge of the casing towards an upper wall of casing. The spindles have ends received by respective recesses of the two sets of recesses. The recesses have a narrowing so as to lock onto a respective end of the spindles. The casing is secured in a slot formed in a lower edge of the sliding leaf. The mounting mechanism enables the casing to rock within the slot. The mounting mechanism is a boss interposed between a bottom of the slot and the upper wall of the casing. The fixing lugs are formed of a flexible and spring material. The fixing lugs are affixed to the lower edge of the sliding leaf.

4 Claims, 1 Drawing Sheet

ROLLING DEVICE HAVING A PLURALITY OF RECESSES FOR ADJUSTING A LEVEL OF A SLIDING LEAF

BACKGROUND OF THE INVENTION (1) Field of the Invention

The invention relates to a rolling device for a sliding leaf of a door, window or the like, including a slide in the shape of a casing having, at the level of its side walls, several recesses of a progressively larger height with respect to the lower edge of these side walls, these recesses receiving spindle ends of at least two railwheels locked at the top by narrowings. The casing is secured, through adequate fixing means, in a groove and/or a slot present in the lower edge of the sliding leaf.

(2) Description of the Prior Art

Many rolling devices meeting the above description are already known.

Thus, such rolling devices for sliding leaves include a slide in the shape of a substantially parallelepipedically shaped casing. This casing is defined by two side walls parallel to each other, an upper wall and transversal walls closing same at each of its front and rear ends. At the bottom of this casing partly protrude railwheels corresponding to the rolling means and rotatingly mounted about horizontal spindles.

Usually, this slide is rigidly mounted in the groove or in the slot provided for this purpose in the lower edge of the profile bar corresponding to the lower rail of the sliding leaf. Now, the fact of thus being rigidly maintained in this groove or in this slot does, in the event of a lack of parallelism between the lower rail of the leaf and the guiding rail on which rests this leaf, not allow both railwheels of the rolling device to simultaneously co-operate with this guiding rail. As a result, the single railwheel in contact will be heavily strained during the movement of the sliding leaf. It will therefore tend to get prematurily worn, so that one will have to periodically replace the railwheel in order to maintain the desired orientation of the leaf. In this respect, the usual approach is to form the stiles in parallel relationship on the leaf and the sash-frame, rather than their respective rails.

Therefore, solutions have been conceived for individually adjusting the position of the railwheels.

U.S. Pat. No. 3,208,109 provides a rolling device in which the user may individually act on each of the railwheels to adjust their protruding position with respect to the bottom of the casing, with a view to adjusting the position of the leaf with respect to the sash-frame. Thus, the tangent to the railwheels may be more or less inclined with respect to the axis of the lower rail of the sliding leaf. However, since in this case adjusting can be carried out only stepwise, it is sure that in 98% of the cases, one will fall back into the above-mentioned configuration, that is to say, the ideal adjustment of the leaf with respect to the sash-frame win correspond to the situation in which only one railwheel effectively rests on the guiding rail present at the level of the lower rail of said sash-frame.

Finally, it would be necessary to be able to more accurately adjust this height position of each of the railwheels, in order to cope with the problem set forth.

SUMMARY OF THE INVENTION

The rolling mechanism of the present invention is simple and efficient, easily manufactured and handled, both during the fitting and after the fitting.

It should in particular be noticed that this invention is provides a solution for the above-mentioned problem.

Thus, the invention relates to a rolling device for a sliding leaf of a door, window or the like, including a slide in the shape of a casing having, at the level of its side walls, several recesses of a progressively larger height with respect to the lower edge of these side walls. These recesses receive spindle ends of at least two railwheels locked at the upper portion by narrowings. This casing is secured through adequate fixing means, in a groove and/or a slot present in the lower edge of the sliding leaf. This rolling device includes means for the rocking mounting, about an axis perpendicular to the plane of the sliding leaf, of the casing inside the groove and/or the slot at the level of the lower edge of this sliding leaf.

According to an advantageous embodiment, the rocking-mounting means are in the shape of a boss interposed between the bottom of the groove and/or the slot and the casing, about which boss the casing is capable of pivoting.

According to another particular feature of this invention, the fixing means associated with the casing are in the shape of fixing lugs extending from the casing at its front portion and at its rear portion. This fixing lug is made of a flexible material, which results into some mobility of the casing.

The casing with its fixing lugs is advantageously made of a molded plastic material.

The advantages resulting from this invention are that the position of the railwheels of the rolling device may be perfectly adjusted in order to allow the railwheels to simultaneously rest on the guiding rail of the lower rail of the sash-frame. This occurs regardless of the amplitude of the lack of parallelism existing between this guiding rail and the lower rail of the sliding leaf. As a result, in comparison with an existing rolling device, the present invention has a longer lifetime, since the railwheels, which share the efforts, are wearing less quickly.

In addition, as will appear later on during the description, the springy character of the fixing lugs allow the standardization, to some extent, of the casing of these rolling devices with respect to grooves or slots of varying depth provided for at the level of the lower edge of the profile bar defining the lower rail of the sliding leaf.

The invention will be better understood when reading the following description which relates to an embodiment given by way of an example and shown in the attached drawing.

BRIEF DESCRIPTION OF THE DRAWINGS

FIG. 2 is a schematical and cross-sectional view of the rolling device as shown in FIG. 1, which the lower rail of a sliding leaf is fitted with.

DESCRIPTION OF THE PREFERRED EMBODIMENTS

Figure 1:
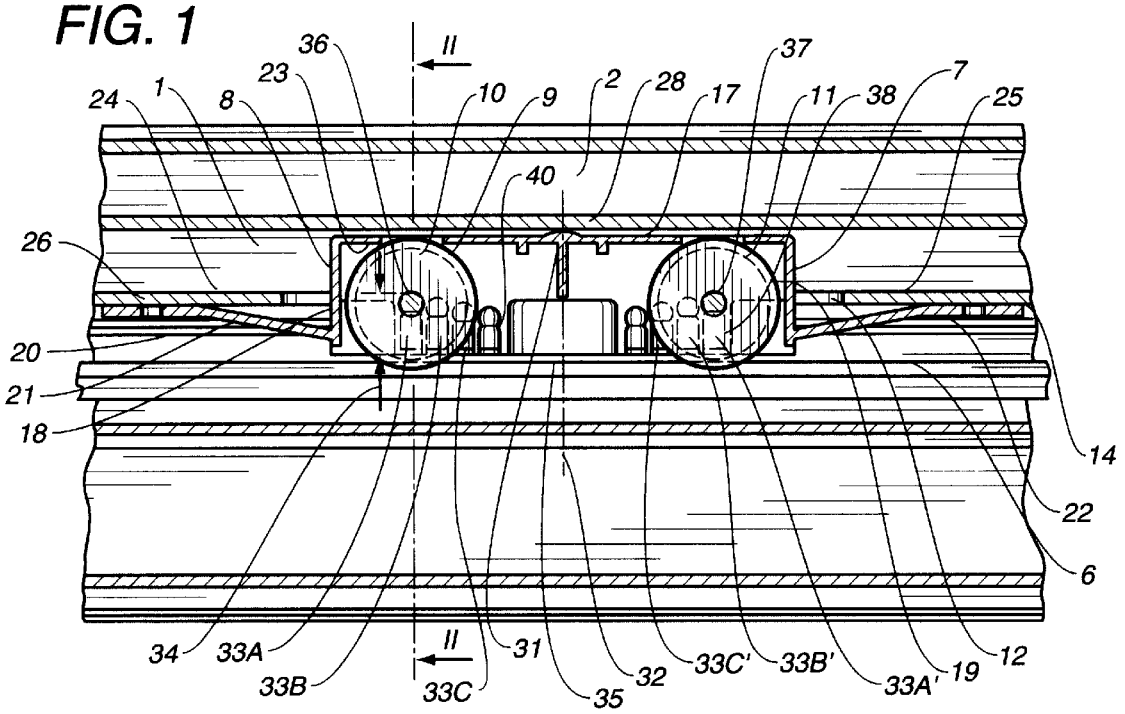
FIG. 1 is a schematical and longitudinal sectional view of a rolling device according to the invention, the wheels being illustrated in transparent fashion.
Figure 2:
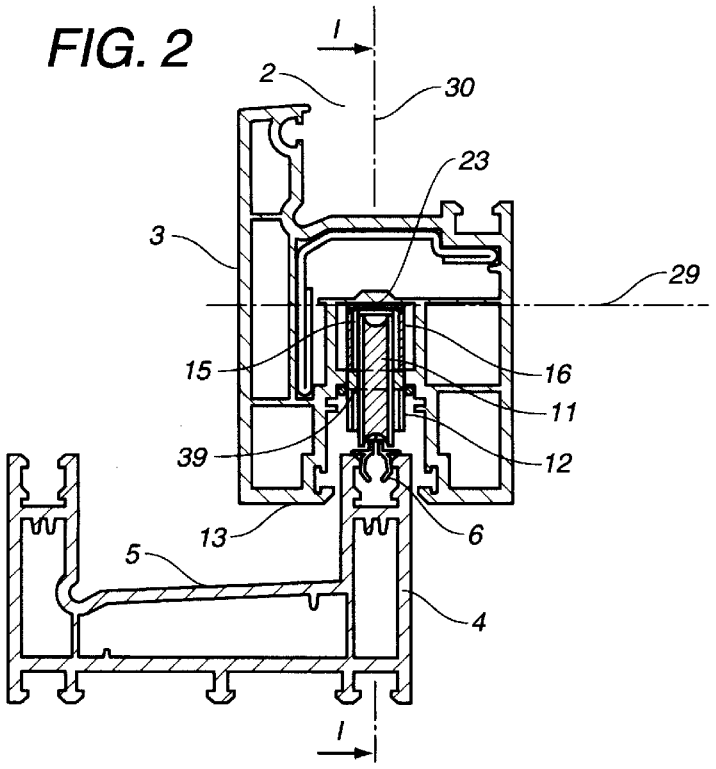

As shown in the figures of the attached drawings, this invention is a rolling device 1 for a sliding leaf 2 of a door, window or the like, only the lower rail 3 of which has been shown in a cross-sectional view in FIG. 2. FIG. 2 furthermore represents a schematical and cross-sectional view of the lower rail 4 of the sash-frame 5 receiving the guiding rail 6 which said rolling device 1 has to co-operate with.

In this respect, the rolling device 1 includes a slide 7 in the shape of a casing 8 receiving rolling means 9. The rolling means 9 includes at least two railwheels 10, 11 arranged behind each other so as to individually cooperate with the guiding 10 rail 6.

The casing 8 is accommodated in a groove and/or a slot 12 present in the lower edge 13 of the lower rail 3 of the sliding leaf 2. In this respect, it should be noticed that this lower rail of the sliding leaf 2 may be in the shape of a profile bar including the groove 12. However, in the case of a wooden joinery, it may be contemplated to provide, in the lower edge of the lower rail, for a slot for receiving this casing 8. Likewise, as shown in FIG. 2, it may happen that the groove 12 present in a profile bar has an insufficient depth to receive the casing 9, so that it is necessary to make a slot in the bottom 14 of this groove 12.

The casing 8 usually has a parallelepipedic shape and therefore includes two side walls 15, 16, an upper wall 17, a front transversal wall 18 as well as a rear transversal wall 19.

This casing 8 is furthermore provided with a fixing mechanism 20, preferably in the shape of fixing lugs 21 and 22 provided respectively at the front 18 and rear 19 transversal walls. Thus, these fixing lugs 21, 22 are made integral, by means of adequate fixing organs, such as screws or the like, either with the bottom 23 of the groove and/or the slot 12, or with the surroundings 24, 25 of the wall 26 in which an eventual slot is made for inserting the casing 8.

The particular feature of the invention resides in that this rolling device 1 includes, in all cases, a rocking-mounting mechanism 28 authorizing the rocking mounting of the casing 8 inside the groove and/or slot 12, about an axis 29 perpendicular to the plane 30 of the sliding leaf 2.

The casing 8 rests on the bottom 23 of the groove and/or so as to support the weight of the sliding leaf 2. The rocking-mounting mechanism 28 is advantageously in the shape of a boss 31 interposed between this bottom 23 of the groove and/or slot and the upper wall 17 of the casing 8. This boss 31 is provided on the upper wall 17 substantially at the transverse median plane 32 of the casing 8. It should be noticed, in this respect, that this boss 31 could be situated at any location at the level of this upper wall 17. In particular, according to another embodiment, the boss 31 may be a slide block mounted in translation, on this upper wall 17 of the casing 8. The position may be adjusted according to the mounting constraints.

In this respect, the rocking-mounting mechanism 28 is completed by fixing means 20 for the casing 8 allowing this casing to have the desired freedom of movement to be able to rock about the top of the boss 31.

According to a first embodiment, this freedom of movement results from securing the fixing lugs 21, 22 with an adequate clearance to the bottom 23 of the groove and/or slot 12 or to the surroundings 24, 25 of the wall 26 in which an eventual slot is made for receiving the casing 8.

According to another embodiment, the fixing lugs 21, 22 are made of a flexible and springy material conferring to the casing 8 the desired mobility. In this respect, it should be noticed that the fixing lugs 21, 22 are long, i.e. the more the fixing organs, such as screws, rivets or the like, are separated from the front 18 and rear 19 transversal walls of the casing 8, the easier this casing can pivot about the boss 31. In addition, by extending the fixing lugs 21, 22, it is possible to become free from the constraints related to keeping within a strict tolerance as regards the length of the slot which has to be provided for in a wall 26 in order to authorize the passing through of the casing 8.

According to an advantageous embodiment of this invention, the fixing lugs 21, 22 are made of synthetic material, like the casing 8, through injection molding. In addition, one should notice the presence, at the level of the side walls 15, 16 of this casing 8, of recesses 33A, 33B, 33C or 33A', 33B', 33C', respectively, of a progressively larger height 34 with respect to the lower edge 35 of these side walls 15, 16. These recesses receive the ends of the pindles 36, 37 on which are pivotally mounted the railwheels 10, 11.

As a result, when adjusting the sliding leaf 2 with respect to the sash-frame 5, the spindles 36, 37 corresponding to the railwheels 10, 11 are positioned in their recess 33A, 33B, 33C or 33A', 33B', 33C', respectively. It should be noticed, in this respect, that these railwheels 10, 11 must not necessarily be inserted into recesses of the same height. Since the casing 8 is able to rock about the boss 31, the difference in height of these railwheels 10, 11 with respect to the guiding rail 6 is indeed systematically compensated for. This in addition allows a very accurate adjustment between the extreme positions of these railwheels 10, 11 in their respective recess 33A, 33B, 33C; 33A', 33B', 33C'.

If one imagines that both railwheels have, during the fitting, unfortunately been inserted into two recesses of different height, the invention advantageously guarantees the proper contact of the railwheels with the guiding rail.

It should be noticed that these latter are preferably defined by recesses 38 provided for on the internal side of the side walls 15, 16 of the casing, which recesses 38 furthermore end at the level of the lower edge 35. In the upper portion 39 of these recesses 38 is furthermore to be noticed a narrowing 40 making necessary the forced insertion, during the mounting, of the spindles 36, 37 corresponding to the railwheels 10, 11 and finally avoiding the unexpected release of same from the casing 8, when removing the sliding leaf 2. As already stated above, the advantages resulting from the present invention are that the rocking character of the rolling device 1 allows proper contact of each of its railwheels 10, 11 with the guiding rail 6, regardless of the angular position of the lower rail of the sliding leaf 2 with respect to the lower rail of the sash-frame 5 of the door, window or the like. As a matter of fact, it should be noticed that the results achieved are also independent from the position of the casing with respect to the lower rail.

There is also an advantage resulting from the mere fact that the fixing lugs 21, 22 are of a flexible and springy nature which are that one and the same casing 8 of a rolling device 1 may be used for being installed in grooves 12 of different depths provided for in the lower edge 13 corresponding to these lower rails 3 of the sliding leaf 2. Finally, such springy fixing lugs allow to some extent to standardize rolling devices for the sliding leaf.

Finally, the combination of a rocking casing and a flexible and springy fixing lug advantageously solves the problems of the prior art. The present invention provides a rolling device of a simple and, enduring design.

What is claimed:

1. An apparatus comprising:

a sliding leaf;

a slide member comprising a casing, said casing having a lower edge and an upperwall, said casing having two sets of recesses, the recesses in each said set of recesses increasing in height from a center of said casing to a respective end of said casing, the recesses in each said set of recesses extending from said lower edge toward said upper wall;

at least two rail wheels each mounted on a spindle, each of said spindles having ends received by a respective pair of said recesses of a respective one of said two sets of recesses, each of said respective pair of said recesses having a narrowing which locks onto a respective said end of a respective one of said spindles, said casing being secured in a slot formed in a lower edge of said sliding leaf;

mounting means affixed to said casing and extending in a direction perpendicular to a plane of said sliding leaf, said mounting means for enabling said casing to rock within said slot, said slot having a bottom, said mounting means comprising a boss interposed between said bottom of said slot and said upper wall of said casing; and fixing lugs affixed to and extending outwardly from said lower edge at respective said ends of said casing, said fixing lugs being formed of a flexible and springy material, said fixing lugs being affixed to said lower edge of said sliding leaf.

2. The apparatus of claim 1, said boss being centered about a transverse median plane of said casing.

3. The apparatus of claim 1, said boss being centered about a transverse median plane of said casing, said boss affixed to said upper wall of said casing.

4. The apparatus of claim 1, said casing and said fixing lugs being formed of a synthetic material.

* * * * *